United States Patent [19]

Ataka

[11] Patent Number: 4,807,816

[45] Date of Patent: Feb. 28, 1989

[54] COMPRESSING AND GRINDING APPARATUS

[76] Inventor: Takashi Ataka, 11-19, Oyodonaka 2-chome, Oyodo-ku, Osaka, Japan

[21] Appl. No.: 222,399

[22] Filed: Jul. 19, 1988

Related U.S. Application Data

[63] Continuation of Ser. No. 935,419, Nov. 26, 1986.

[30] Foreign Application Priority Data

Dec. 23, 1985 [JP] Japan ..... 60-289816
Jun. 4, 1986 [JP] Japan ..... 61-85802

[51] Int. Cl.[4] ..... B02C 19/22
[52] U.S. Cl. ..... 241/67; 241/260.1
[58] Field of Search ..... 366/320, 322, 323; 241/65, 66, 67, 260.1, 300

[56] References Cited

U.S. PATENT DOCUMENTS

| | | | |
|---|---|---|---|
| 970,240 | 9/1910 | Kilborn | 366/323 X |
| 3,102,694 | 9/1963 | Frenkel | 241/260.1 X |
| 3,912,179 | 10/1975 | Hartig et al. | 241/260.1 X |
| 4,408,725 | 10/1983 | Wenger et al. | 241/260.1 |
| 4,645,445 | 2/1987 | Takanashi | 366/323 X |

FOREIGN PATENT DOCUMENTS 31943 7/1982 Japan .

*Primary Examiner*—Mark Rosenbaum
*Attorney, Agent, or Firm*—Armstrong, Nikaido, Marmelstein & Kubovcik

[57] ABSTRACT

An apparatus for grinding the crusts of seeds, trunks, branches and leaves of any plant of a family of grasses, particularly rice hulls, includes an outer cylinder having an inner surface which is similar to that of a mortar, and a screw having a spiral screw thread and extending through the cylinder. The cylinder and the screw are rotatable relative to each other. They define therebetween a space having a gradually decreasing inner cross-sectional area in which the material to be ground is progressively compressed and heated, whereby the material has its structure destroyed and produces fine particles. The apparatus has a high degree of efficiency and a high degree of durability. The ground product has only a low content of lignin having an adverse effect on its compatibility with a synthetic high molecular compound or its dispersibility therein and is, therefore, useful as a filler or modifier therefor. It is also useful as a food filler or a culture medium, as it can easily be divided into still finer particles which can easily be absorbed into the body of an animal or a plant.

13 Claims, 6 Drawing Sheets

A
B
C
1
2
3
4
5
6
7
8
9
10
11
12
13
31
32
33
34

COMPRESSING AND GRINDING APPARATUS

This application is a continuation of application Ser. No. 935,419 filed Nov. 26, 1986.

BACKGROUND OF THE INVENTION

1. Field of the Invention

This invention relates to a method and an apparatus for crushing the crusts of seeds, trunks, branches, leaves, etc. of plants belonging to a family of grasses. More particularly, it is a compressing and grinding apparatus which applies pressure and heat to the crusts of seeds of cereals having a strong cell structure, such as rice hulls, and crushes them until even their cells are destroyed.

2. Description of the Prior Art

The crusts of seeds of any plant belonging to a familty of grasses, such as rice hulls, and the trunks, branches and leaves of plants of rice, barley or wheat, millet, etc. are very difficult to crush, as they contain a siliceous substance. Therefore, they can hardly be absorbed into the body of an animal or a plant. Even if they can be crushed into fine particles, they cannot be used as a filler or modifier for any synthetic high molecular compound, as they have only a low degree of compatibility with the compound, or a low degree of dispersibility therein. The disposal of a large amount of rice hulls, etc. resulting from threshing presents a big problem.

There is known an apparatus for crushing any such material. It comprises a screw and an outer cylinder which defines therebetween a space having a gradually decreasing cross-sectional area. The material to be crushed is fed through the space and is thereby ground and kneaded. There is also known a ball mill which can grind various kinds of materials into fine particles. There is, however, not known any apparatus that is suitable for grinding into fine particles the crusts of cereal seeds, such as rice hulls, having a strong cell structure and a volume which is greatly reduced when they are crushed. There has long been a strong demand for an apparatus which is effective for such purposes.

I, the inventor of this invention, thought that it would be effective to employ a method comprising feeding rice hulls, etc. into a space defined between a screw and an outer cylinder and having a gradually decreasing cross-sectional area, and grinding them under pressure and heat. I have, therefore, been making extensive efforts to obtain an improved apparatus which can effectively carry out the method. A maximum normal stress of 6 to 7 tons/cm$^2$ and a maximum shearing stress of 2 tons/cm$^2$ bear on the thread at the leading end of the screw. It is heated to a high temperature in the range of 450° C. to 500° C. by the heat of friction and the heat which is supplied from an external source. Therefore, the screw in the conventionally available apparatus got worn so easily at the end thereof that it could withstand use for only several hours. It was necessary to change the screw very often. In order to obtain a screw of improved wear and impact resistance, I have tried to harden the surface of the screw, which is formed from tool steel, by coating it with a ceramic material. The surface of the screw is, however, heated to a high temperature by the heat of friction and the heat applied thereto, as hereinabove stated. The difference in thermal expansibility between the steel and the ceramic material causes the development of a large internal stress in the screw. This stress and the external stress as hereinabove stated give rise to the separation of the ceramic coating from some portions of the screw and thereby the exposure of the steel in those portions. The wear of those portions proceeds to a greatly increased degree and eventually results in the wear of the screw as a whole. The screw can withstand use for only several days. Whenever the screw becomes unusable, it is necessary to discontinue the use of the apparatus and disassemble it to change the screw.

The serious drawbacks of the conventional apparatus as hereinabove pointed out are due to the construction and material of the screw, as well as of the outer cylinder. The apparatus has only a low degree of operating efficiency or productivity. The use of a large number of screws disables a reduction in the cost of the grinding operation.

SUMMARY OF THE INVENTION

Under these circumstances, it is an object of this invention to provide an apparatus which can effectively grind the crusts of seeds, trunks, branches and leaves of any plant of a family of grasses containing a large amount of a siliceous substance and having a very strong cell structure, and which is particularly effective for grinding the crusts of cereal seeds, such as rice hulls, having a volume which is greatly reduced when they are crushed.

It is another object of this invention to provide a grinding apparatus including a screw of improved wear resistance which can withstand a long time of continuous or intermittent use and shorten the down time of the apparatus for its changing to thereby improve the operating efficiency of the apparatus and reduce the cost of the grinding operation.

It is still another object of this invention to provide an apparatus which can efficiently manufacture a ground product which is useful for many purposes.

These objects are attained by an apparatus which comprises an outer cylinder formed from a material of high wear and impact resistance and having an inner surface similar to that of a mortar, a screw formed from a material of high wear and impact resistance and having a spirally threaded outer surface stepped to define a diameter decreasing from one end thereof to another, the screw having a feeding portion and a compressing portion which are unitary or separate from each other, the outer cylinder and the screw being rotatable relative to each other and defining therebetween a space having a progressively decreasing cross-sectional area into which the material to be compressed and ground can be fed progressively, compressed at a pressure of 1 to 100 tons/cm$^2$ and heated to a temperature of 150° C. to 600° C. by the heat of friction or by both the heat of friction and the heat supplied from an external source so that the structure of the material may be destroyed by the pressure and the heat, and a sleeve connected to one end of the outer cylinder and having an inner cross-sectional shape varying from polygonal to circular, so that the material ground in the outer cylinder may be prevented from rotation and moved forward continuously by the screw.

The ground product contains only a small amount of lignin having an adverse effect on the compatibility of the material with a synthetic high molecular compound or its dispersibility therein, as it is burned away when the material is compressed and heated. Therefore, it can be used as a filler or modifier for any such compound if it is further ground into fine particles by a known apparatus. Moreover, it can also be used as a food filler or culture medium, as it can be ground into so fine particles as can easily be absorbed into the body of an animal or a plant.

Other objects, features and advantages of this invention will become apparent from the following description, the appended claims and the accompanying drawings.

DETAILED DESCRIPTION OF THE INVENTION

According to this invention, the material to be ground is compressed at a pressure of 1 to 100 tons/cm$^2$ and the components of the material are rubbed against one another so that their structure may be destroyed. If the pressure which is applied to the material is lower than 1 ton/cm$^2$, the material cannot be fed through the apparatus smoothly. The use of any pressure exceeding 100 tons/cm$^2$ results in an undesirably high cost of operation. The pressure applied to the material and the friction thereof generate the heat which can be used for heating the material. If it does not raise the temperature of the material sufficiently, an external source of heat may be used for heating it additionally. The material is heated to a temperature of 150° C. to 600° C., preferably about 300° C. If the material is heated only to a temperature which is lower than 150° C., it is likely to stay undesirably in the apparatus and disable its continuous operation. The use of any temperature exceeding 600° C. causes the material to burn and give a product of unacceptable quality.

Reference is now made to the accompanying drawings showing by way of example the apparatus of this invention which can be used for carrying out the grinding operation as hereinabove described.

Figure 1:
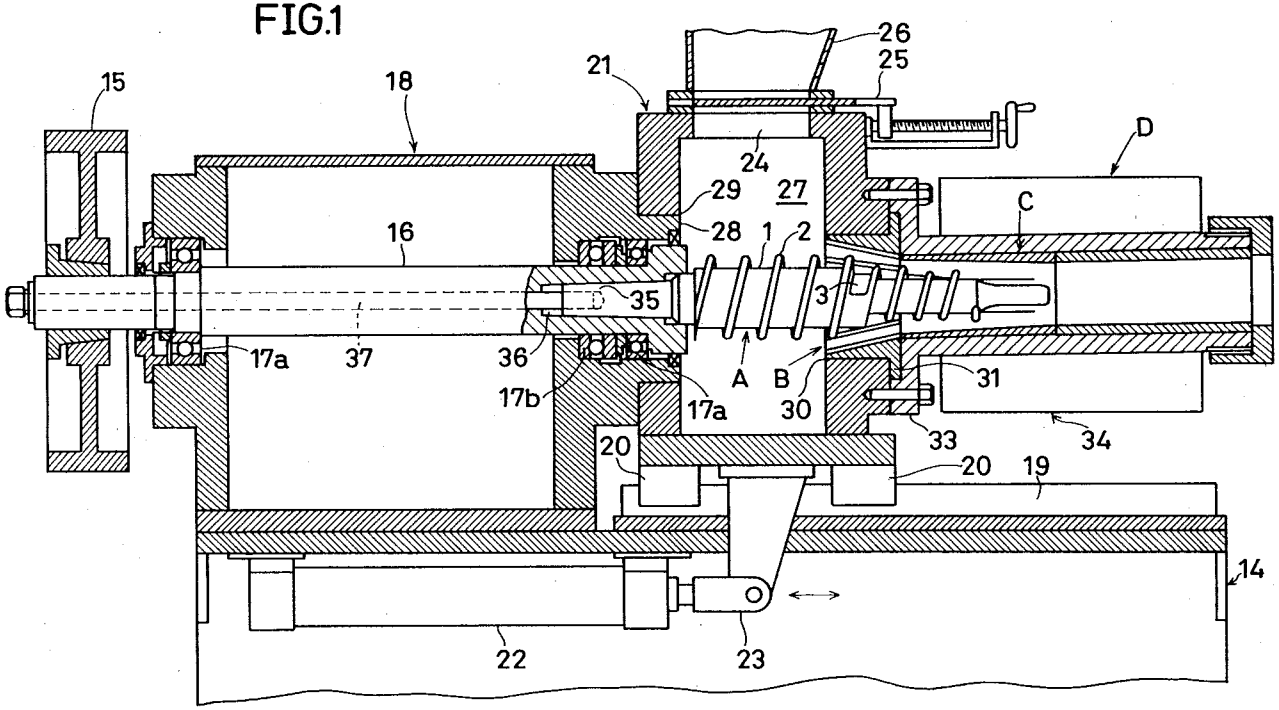
FIG. 1 is a fragmentary side elevational view, partly in section, of an apparatus according to a first embodiment of this invention for grinding the crusts of cereal seeds, such as rice hulls.
Figure 2:
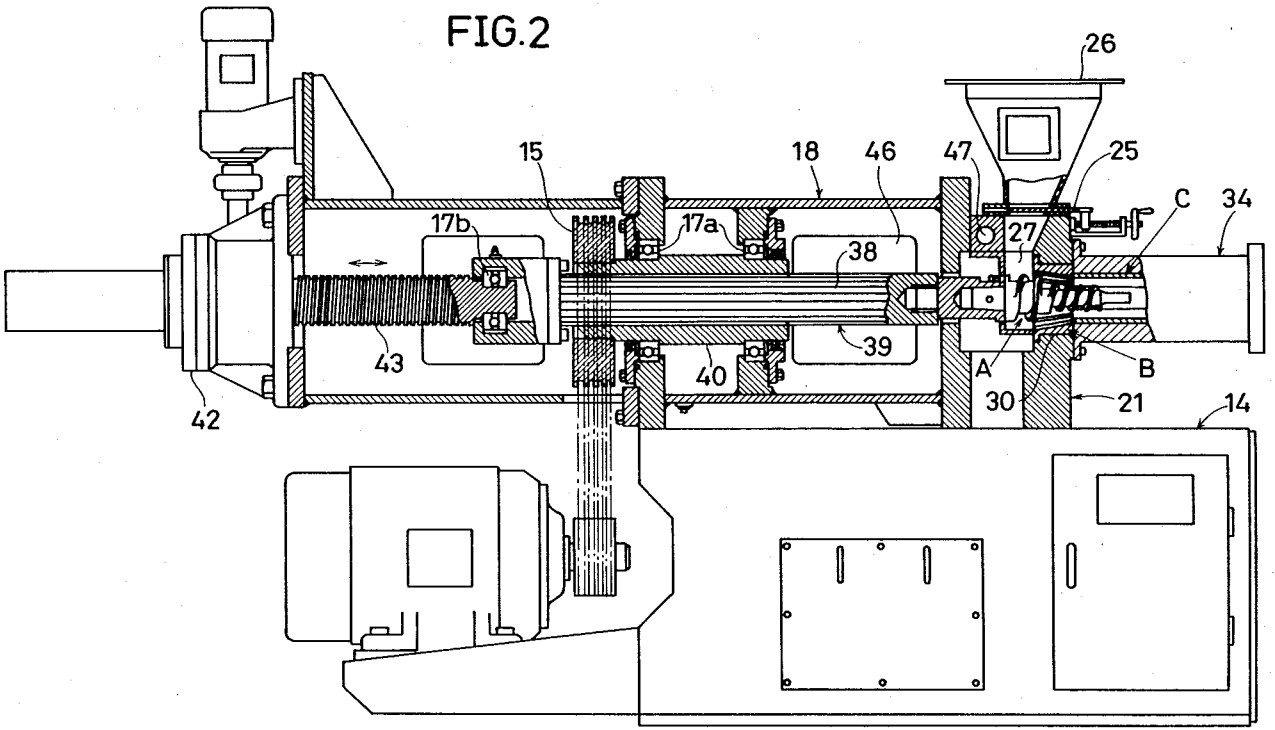
FIG. 2 is a side elevational view, partly in section, of an apparatus according to a second embodiment of this invention.
Figures 3, 4:
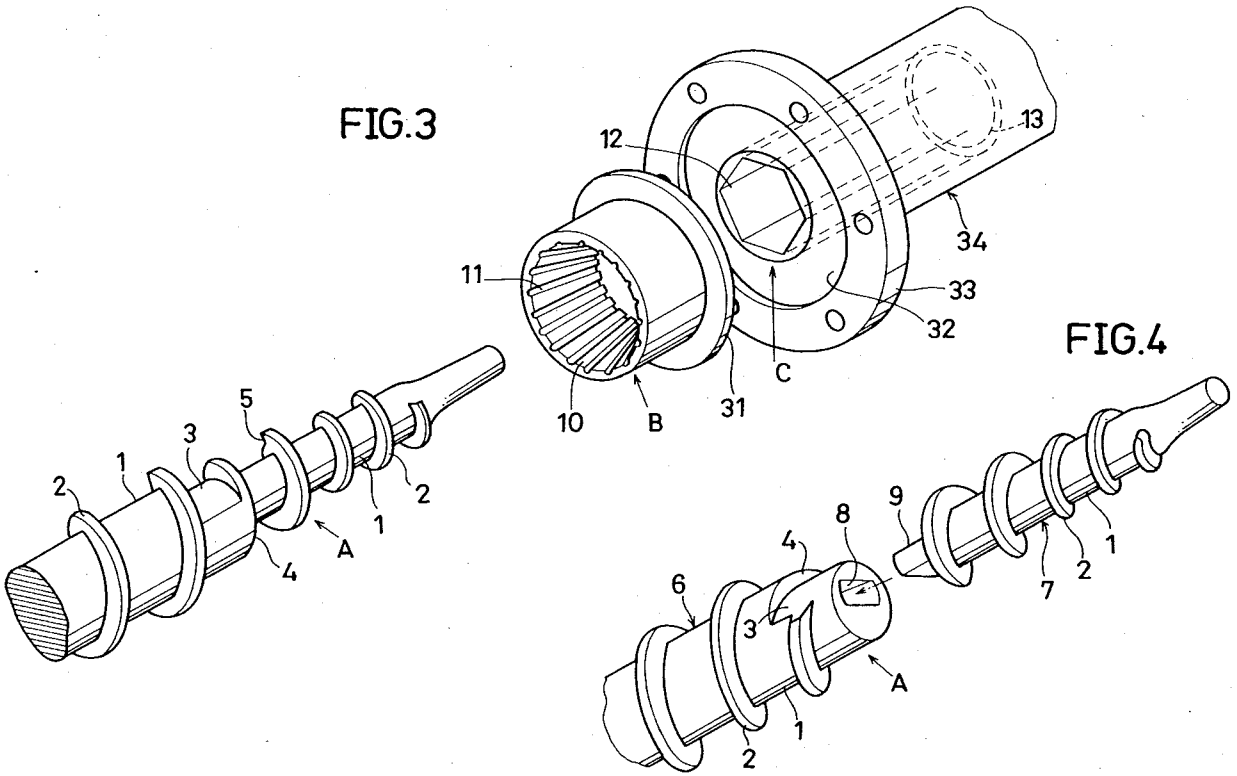
FIG. 3 is an enlarged exploded perspective view of a portion of the apparatus shown in FIG. 1.
FIG. 4 is a partly omitted perspective view of a screw comprising a feeding portion and a compressing portion which can be connected with the feeding portion.
Figure 5:
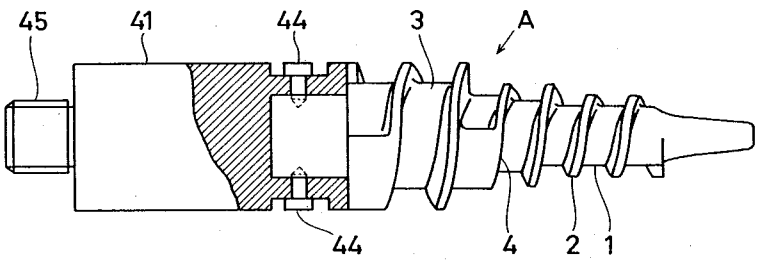
FIG. 5 is a side elevational view, partly in section, of the screw joined to an attachment.

An apparatus according to a first embodiment of this invention, which is particularly suitable for grinding rice hulls, is shown in FIG. 1 and a detailed portion thereof in FIG. 3, while a second embodiment of this invention is shown in FIG. 2. The two embodiments are basically identical in construction, but the screws which they include are removable in different ways. According to the first embodiment, the apparatus has a main body which is movable to a position enabling the removal of the screw. According to the second embodiment, the screw is movable with its driving shaft to a position in which it is removable therefrom. As the two embodiments are basically identical in construction, the following description will mainly be directed to the first embodiment. It comprises a screw A, an outer cylinder B, a sleeve C and a heater D. The screw A comprises a substantially cylindrical ceramic body 1 having an outer periphery formed with a right-handed screw thread 2. The diameters of the body 1 and the screw thread 2 decrease discontinuously from one end of the screw to the other. The body 1 has two portions of different diameters and the screw thread 2 has two portions of different diameters. A recess 3 is provided between the two portions of the body 1 and defines a flank 4 therebetween. The screw thread 2 is separated into the first and second portions at the boundary between the two portions of the body 1. The flank 4 is connected to the second portion of the screw thread 2. A shoulder 5 is provided between the second and third portions of the screw thread 2. Each portion of the screw thread 2 is equally pitched and the second portion of the screw thread 2 has a smaller pitch than that of the other portions thereof. Although the screw thread 2 has been described as having the shoulder 5, it is alternatively possible to vary the diameter of the screw thread 2 continuously in that area. Although the screw A has been described as being formed from a ceramic material, it is also possible to employ a screw of ultrahard or tool steel having a hardened surface coated with a ceramic material. Although the screw A has been shown as being of the unitary construction, it is also possible to employ a screw A comprising a rear feeding portion 6 and a front compressing portion 7 which are separable from each other, as shown in FIG. 4. The feeding portion 6 has a hole 8 at its front end and the compressing portion 7 has at its rear end a projection 9 which can be inserted into the hole 8 to connect the portion 7 with the portion 6 so that the two portions may be rotatable together. Both of the two portions 6 and 7 may be formed from a ceramic material or ultrahard steel. Alternatively, only the compressing portion 7 may be formed from a ceramic material or ultrahard steel, while the feeding portion 6 is formed from tool steel and has a surface coated with a ceramic material.

The outer cylinder B is disposed about the boundary of the two portions of the screw A and is radially outwardly spaced apart therefrom. It is a ceramic cylinder having an inner surface 10 which is tapered from the large diameter portion of the screw A to the small diameter portion thereof. The inner surface 10 has a multiplicity of parallel grooves 11 extending from one end of the cylinder B to the other. It is not essential to use a ceramic cylinder, but it is also possible to employ a cylinder of ultrahard steel or a cylinder of tool steel having a hardened surface coated with a ceramic material.

The sleeve C has an inside diameter which enables it to surround the screw thread 2 adjacent to its front end in appropriately spaced apart relation therefrom. It has a rear end connected to the front end of the outer cylinder B having a smaller diameter than that of any other portion thereof. The sleeve C includes a rear portion having an inner surface 12 which is polygonal in cross section and a front portion having an inner surface 13 which is circular in cross section. The polygonal inner surface 12 is continuously deformed into the circular inner surface 13. Although FIG. 3 shows the inner surface 12 as having a hexagonal cross section, it is also possible to employ any other cross-sectional shape if it enables the ground material to move forward smoothly without rotating unnecessarily.

The heater D surrounds the sleeve C. While it is shown only diagrammatically in FIG. 1, it may be a known electric resistance or fuel-fired heater, or any other type of heater containing an appropriate source of heat and covered by an appropriate heat-insulating material. It is usually sufficient to use a heater which can be used continuously for a long time to heat the material to a temperature of, say, 600° C. However, it may sometimes be necessary to use a heater of higher capacity, depending on the material to be treated or the final condition of treatment which is desired, such as the degree of carbonization.

The apparatus includes a driving device 18 mounted on a base 14, as shown in FIG. 1. The driving device 18 includes a driving wheel 15 and a driving shaft 16 to which the rotation of the driving wheel 15 is transmitted. The driving shaft 16 is supported by two kinds of bearings, i.e. a transverse bearing 17*a* and a longitudinal bearing 17*b*, not only rotatably, but also axially movably. Two rails 19, of which only one is shown in FIG. 1, are provided adjacent to the driving device 18 and extend in parallel to the driving shaft 16. The apparatus also includes a grinding device 21 having at its bottom appropriately spaced apart wheels 20 which are slidably engaged with the rails 19. A hydraulic cylinder 22 is secured to the base 14 and has a movable portion 23 connected to the grinding device 21 to enable it to slide longitudinally of the driving shaft 16. The grinding device 21 has a top opening 24 through which rice hulls can be introduced thereinto. A hopper 26 is provided over the opening 24 and a door 25 is provided between the opening 24 and the bottom of the hopper 26. The grinding device 21 has an internal space 27 in which rice hulls can be held. The driving device 18 has an annular end wall projection 28 surrounding the driving shaft 16 at its front end. The grinding device 21 has at its rear end a circular opening 29 in which the wall projection 28 is fitted. The grinding device 21 is also provided at its front end with a hole 30 in which the outer cylinder B is fitted. The outer cylinder B has a flange 31 extending radially outwardly from its front end at which its tapered bore has the smallest diameter. The flange 31 bears on the outer surface of the rear end wall of the grinding device 21. A delivery cylinder 34 holding the sleeve C therein has a flange 33 at one end thereof where the outer end of the sleeve portion having the polygonal inner surface 12 is located. The flange 33 has a circular recess 34 which is coaxial with the sleeve C. The flange 31 of the outer cylinder B is fitted in the recess 32, whereby the outer cylinder B is secured between the grinding device 21 and the delivery cylinder 34. The smallest diameter end of the tapered bore of the outer cylinder B is connected with the outer end of the sleeve bore having the polygonal inner surface 12. The screw A has a connecting portion 35 extending axially from its rear end and the driving shaft 16 has at its front end an axial hole 36 into which the connecting portion 35 is connected. The shaft 16 has an axial bore through which a bolt 37 extends from its rear end. The bolt 37 is threadedly connected into the end of the connecting portion 35 to secure the screw A in position. Alternatively, it is sufficient to merely connect the screw portion 35 threadedly into the front end of the shaft 16.

Referring to FIG. 2, the second embodiment includes a driving shaft 39 which is a spline shaft having longitudinal grooves 38 and a driving bearing 40 which is slidably engaged with the grooves 38. A driving wheel 15 is secured to the bearing 40. A screw A is provided with an attachment 41 which is threadedly connected to the front end of the driving shaft 39. The opposite end of the shaft 39 is rotatably connected to the sliding rod 43 of a screw jack 42 by which the shaft 39 is slidable. The screw A may be formed from a ceramic material or ultrahard steel, or may be formed from tool steel and coated with a ceramic material. The attachment 41 may, for example, be formed from tool steel. The screw A has a rear end engaged into the attachment 41 and secured thereto by screws 44. The attachment 41 has at its opposite end from the screw A a screw 45 by which it is threadedly connected with the driving shaft 39. The driving device 18 has on one side thereof a window 46 which provides access to the attachment 41 when the driving shaft 39 is axially moved away from the outer cylinder B by the screw jack 42. The use of the attachment 41 has the advantages of facilitating the removal or replacement of the screw A through the window 46 and shortening the screw A to thereby reduce the cost thereof.

According to another feature of the second embodiment, the outer cylinder B has a radially outwardly extending flange 31 formed at its rear end facing the internal space 27 of the grinding device 21. The flange 31 so located is particularly effective against any high outwardly directed pressure arising from the operation of the screw A. The grinding device 21 has on one side thereof a port 47 which is connected with the internal space 27 for exhausting therefrom the water vapor rising from rice hulls when they are compressed and ground, and thereby preventing any explosion resulting from the collection of water vapor. The vent 47 can alternatively be formed through the wall of the outer cylinder B.

Figure 6:
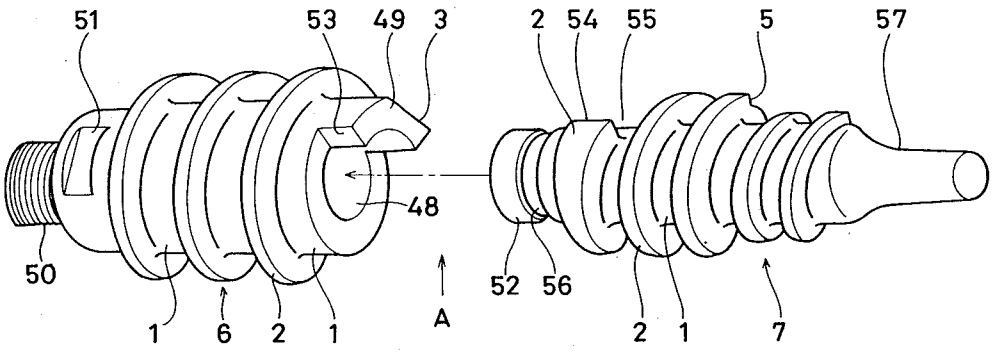
FIG. 6 is an exploded perspective view of a different type of screw.
Figure 7:
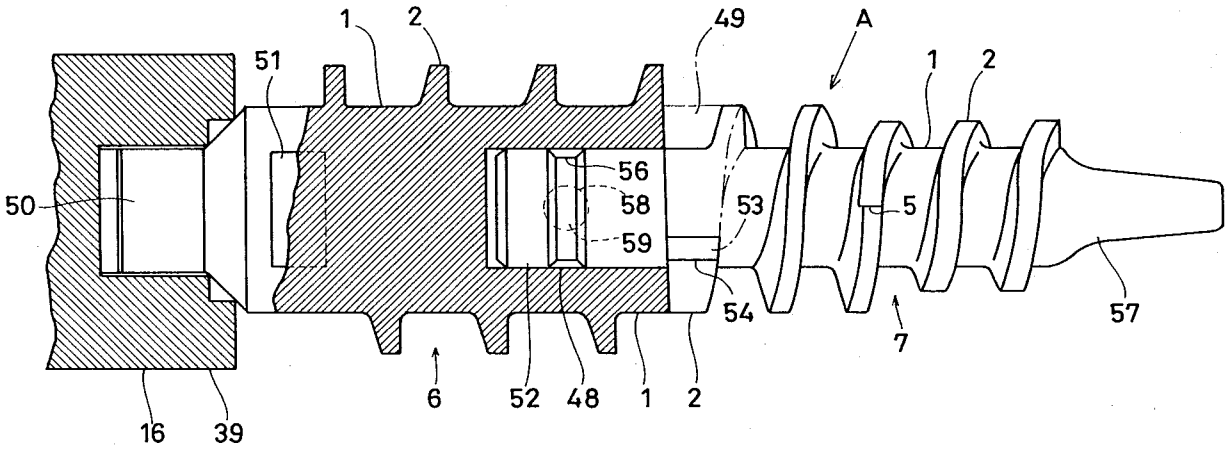
FIG. 7 is a side elevational view, partly in section, showing the screw of the type shown in FIG. 6 and a driving shaft connected thereto.

Another separable type of screw A is shown in FIG. 6. It has a feeding portion 6 which comprises a cylindrical body 1 having a screw thread 2 formed thereabout. The feeding portion 6 has at its front end a connecting hole 48 which is coaxial with the body 1. An arcuate projection 49 extends longitudinally of the body 1 from the periphery of the connecting hole 48. The feeding portion 6 also has an externally threaded shaft 50 projecting from its rear end coaxially with the body 1. The body 1 has adjacent to the shaft 50 a recess 51 with which a spanner is engageable for turning the body 1. The screw A also has a compressing portion 7 which also comprises a cylindrical body 1 having a screw thread 2 formed thereabout. The body 1 of the feeding portion 7 has an outside diameter which is equal to the diameter of the connecting hole 48 of the feeding portion 6. The screw thread 2 of the compressing portion 7 has an outside diameter which is equal to the outside diameter of the body 1 of the feeding portion 6. The compressing portion 7 has at its rear end an axial projection 52 which can be fitted into the connecting hole 48. The arcuate projection 49 has a pair of ends 53. The screw thread 2 on the compressing portion 7 is partly cut away adjacent to its rear end to form an arcuate recess 55 with an arcuate projection 54. The arcuate projection 49 can be fitted in the arcuate recess 55 and the ends 53 of the projection 49 are engageable with the ends of the projection 54. A groove 56 extends about the axial projection 52. The compressing portion 7 has a tapered front end 57 extending from the body 1. The two portions 6 and 7 of the screw A are connected to each other as shown in FIG. 7. The threaded shaft 50 of the feeding portion 6 is threadedly connected into the front end of the driving shaft 16 or 39 by means of a spanner engaged with the recess 51 in a direction opposite the direction in which the shaft 16 or 39 is rotatable. The axial projection 52 of the compressing portion 7 is inserted into the connecting hole 48 of the feeding portion 6. The projection 54 of the compressing portion 7 is engaged with the ends 53 of the arcuate projection 49 on the feeding portion 6. The body 1 of the feeding portion 6 has a threaded hole 58 connected with the connecting hole 48. A holding screw 59 is threadedly inserted through the hole 58 until its inner end reaches the groove 56 to hold the compressing portion 7 against separation from the feeding portion 6. The screw A shown in FIGS. 6 and 7 has an overall shape which is equal to that of the screw A shown in FIG. 3. The screw thread 2 has a pitch and an outside diameter decreasing toward the front end of the screw A to enable the multiple steps of compression and the smooth delivery of the ground product. As the diameter of the body 1 of the compressing portion 7 is equal to the diameter of the connecting hole 48 of the feeding portion 6, the body 1 of the screw A as a whole has an outside diameter decreasing discontinuously toward its front end. As the outside diameter of the screw thread 2 on the compressing portion 7 is equal to that of the body 1 of the feeding portion 6, the screw thread 2 on the screw A as a whole has an outside diameter discontinuously toward the front end of the screw A. The screw thread 2 on the compressing portion 7 is formed intermediate the ends thereof with a shoulder 5 which reduces the outside diameter of the screw thread 2 discontinuously. The arcuate projection 49 has a recess 3 on its radially outside surface. The screw thread 2 on the compressing portion 7 has a smaller pitch than that of the screw thread 2 on the feeding portion 6.

Figure 8:
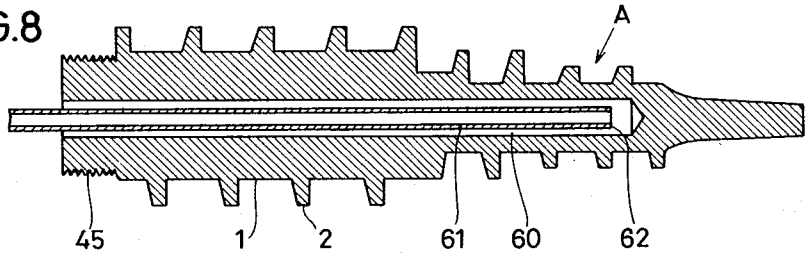
FIG. 8 is a longitudinal sectional view of a screw of the water cooled type.
Figure 9:
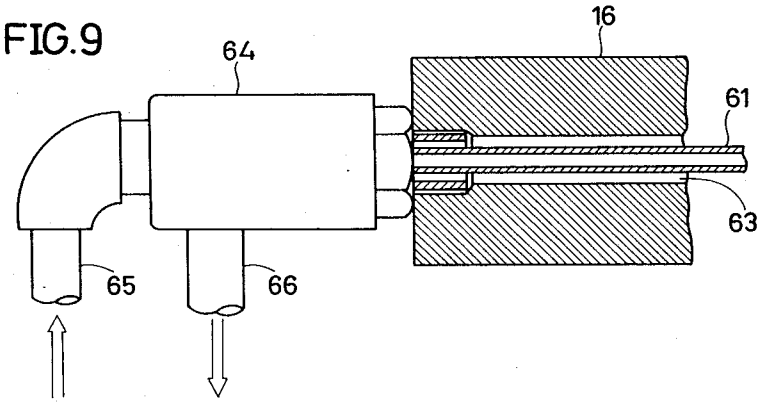
FIG. 9 is a fragmentary side elevational view, partly in section, of a system provided at one end of the driving shaft for supplying cooling water to the screw and collecting it therefrom.

The water cooling of the screw A is effective for increasing its durability. A water-cooled screw A is shown by way of example in FIG. 8. The body 1 of the screw A has an axial bore 60 in which a cooling water tube 61 is disposed. The tube 61 has an outside diameter which is smaller than the diameter of the bore 60. The tube 61 has an inner end which is somewhat spaced apart from the bottom of the bore 60. The driving shaft 16, to which the screw A is connected, has an axial bore 63 having a diameter which is substantially equal to that of the bore 60 of the screw A. The cooling water tube 61 extends through the bore 63, as shown in FIG. 9. A rotary joint 64 is attached to the rear end of the driving shaft 16 remote from the screw A. The rotary joint 64 is connected to two water passages which are defined within the tube 61 and by the bore 63 surrounding the tube 61, respectively. The joint 64 is rotatable relative to the driving shaft 16. The rotary joint 64 is provided with a water supply pipe 65 connected to the tube 61 and a water discharge pipe 66 connected to the bore 63 surrounding the tube 61. The cooling water leaving the water supply pipe 65 flows into the tube 61 and the water leaving the tube 61 at its inner end 62 enters the bore 60 to cool the screw A. The water leaving the bore 60 flows through the driving shaft 16 and is discharged through the water discharge pipe 66.

The apparatus of this invention as hereinabove described can, for example, be used for grinding rice hulls as will hereinafter be described. The rice hulls to be ground are placed in the hopper 26 and the door 25 is opened to cause the rice hulls to drop into the internal space 27 of the grinding device 21. The rice hulls are gradually fed into the space defined between the rotating screw A and the outer cylinder B and having a progressively decreasing cross section by the screw thread 2 on the feeding portion 6 of the screw A. They are fed past the recess 3 on the body 1 of the screw A and along the flank 4 to the compressing portion 7. As they are fed into the space having a still smaller cross section, they are compressed at a high pressure. The rice hulls are rubbed against the grooves 11 on the inner surface 10 of the outer cylinder B and also against one another, whereby the heat of friction is generated. They are heated to a high temperature in the range of 150° C. to 600° C. by the heat of friction and the heat supplied by the heater D, whereby even their cells are destroyed. At the same time, the rice hulls decrease their lignin content. The ground product of the rice hulls is effectively carried forward through the sleeve C. The polygonal inner surface 12 of the sleeve C prevents the ground product contacting the compressing portion 7 of the screw A from rotating with the screw A. The ground product is rotated only at a lower speed than that of the screw A. This difference in rotating speed allows the ground product to move forward without staying about the screw A. The heater D heats not only the sleeve C, but also the outer cylinder B to apply heat to the rice hulls being ground and the ground product thereof to enhance the effectiveness of the grinding operation. A temperature which is higher than about 600° C. can be employed for carbonization purposes, if required.

The apparatus of this invention has a number of advantages which may have been obvious from the foregoing description, and which will become more apparent from the following description. The screw has a body diameter and a screw thread diameter which decrease in a stepped pattern from its rear end to its front end. The stepped portion of the body is recessed to provide continuity. Each stepped portion of the screw thread is equally pitched and the screw thread closest to the front end of the screw has a smaller pitch than that of any other portion thereof. The screw is connected to the driving shaft easily removably. The outer cylinder surrounds the reduced diameter portion of the screw and has an inside diameter which decreases in a tapering way with a reduction in the diameter of the screw. The inner surface of the cylinder has a multiplicity of grooves extending in parallel to the axis of rotation of the screw. The rice hulls are gradually fed forward and compressed by the screw thread on the screw in the space defined between the screw and the outer cylinder and having a progressively decreasing cross-sectional area. The hulls are rubbed against one another and against the inner surface of the outer cylinder. The resulting heat of friction and the additional heat supplied by the heater surrounding the sleeve can heat the rice hulls to a high temperature up to several hundred degrees Centigrade. The recess on the body of the screw enables the smooth delivery of the rice hulls to a higher pressure side and the flank defined by the recess compresses the hulls and pushes them forward. This arrangement is particularly effective for the grinding of rice hulls having a volume which is greatly reduced during the initial period of compression. The polygonal inner surface of the sleeve prevents the ground product from contacting the screw and rotating therewith. The difference in rotating speed between the screw and the ground product enables the smooth delivery of the ground product through the screw. The heater surrounding the sleeve heats not only the sleeve, but also the outer cylinder to apply heat to the rice hulls being ground and the ground product in the sleeve to thereby enhance the effectiveness of the grinding operation. The apparatus of this invention can efficiently grind the crusts of seeds, trunks, branches and leaves of grasses and is particularly useful for grinding the crusts of cereal seeds, such as rice hulls, having a strong cell structure. The ground product is easy to divide into finer particles by a conventionally available grinder. The ground product obtained by the method and apparatus of this invention is useful as a filler or modifier for a synthetic high molecular compound, as it has a greatly reduced content of lignin having an adverse effect on its compatibility with the compound or its dispersibility therein. It is also useful as a filler for food for animals or a culture medium for various kinds of plants, as it is easily absorbable into the body of an animal or a plant, and as it is sterile as a result of heat treatment at a temperature of several hundred degrees Centigrade.

According to the first embodiment, the grinding device is slidable to facilitate the removal of the outer cylinder from the screw. According to the second embodiment, the driving shaft to which the screw is connected is axially movable to facilitate the removal of the screw from the outer cylinder. In either event, the screw can be changed easily and quickly. The use of a ceramic material or ultrahard steel enables an increase in durability of the screw and a reduction in the down time of the apparatus which is required when the screw is changed. Accordingly, it enables a reduction in the wear of the screw and the cost of the grinding operation. It is possible to use a ceramic material or ultrahard steel for only the front compressing portion of the screw which is highly liable to wear and connect it to its rear feeding portion which is less liable to wear, or an appropriate attachment. This construction contributes to increasing the durability of the screw and makes it possible to change the screw quickly and thereby raise the operating efficiency of the apparatus. The water-cooled screw has a sufficiently high degree of durability for practical use, even if it is formed from tool steel and coated with a ceramic material.

The apparatus of this invention can effectively reduce the lignin content of the ground product of rice hulls, etc. Therefore, the product is useful not only as a filler for a synthetic resin, but also as a food filler or a medium for the culture of a microorganism, also in view of the fact that it is a product of heat treatment.

What is claimed is:

1. An apparatus for compressing and grinding a material such as crusts of seeds, rice, hulls, trunks, branches and leaves of plants and grasses, especially those containing a siliceous material, said apparatus comprising:

an outer cylinder having an inner surface which has a tapered frusto-conical shape in cross-section and a plurality of axially-extending grooves in said inner surface, a sleeve co-axially connected at one end thereof to a downstream side of said outer cylinder and having an inner cross-sectional shape varying continuously from polygonal to circular from said one end to the other, and a screw axially aligned with and extending through said cylinder and into said sleeve, and said cylinder and said screw defining a spacing having a decreasing cross-sectional area in which the material is compressed and ground at a pressure of from 1 to 100 tons/cm$^2$ and heated to a temperature of from 150° to 600° C., said screw including feeding-compressing portion, an intermediate portion, and a compressing-grinding portion and having a body diameter and a screw thread diameter, said body diameter and said screw thread diameter each decreasing discontinuously in said intermediate portion, said intermediate portion being positioned within said outer cylinder, the pitch of each portion being uniform and the pitch of the compressing-grinding portion being smaller than the pitch of the feeding-compressing portion.

2. An apparatus as claimed in claim 1, wherein said body diameter of the screw has a recess in the region between the two portions of the screw.

3. An apparatus as claimed in claim 1, wherein said two screw portions are detachably connected together for ease of replacement.

4. An apparatus as claimed in claim 1, wherein a heater is provided to heat the material being compressed and ground.

5. An apparatus as set forth in claim 1, wherein said screw is formed from a ceramic material.

6. An apparatus as set forth in claim 5, wherein said ceramic material is selected from the group consisting of alumina and silicon carbide.

7. An apparatus as set forth in claim 6, wherein said outer cylinder is formed from a ceramic material.

8. An apparatus as set forth in claim 7, wherein said ceramic material is selected from the group consisting of alumina and silicon carbide.

9. An apparatus as set forth in claim 1, wherein said screw is formed from ultrahard steel.

10. An apparatus as set forth in claim 1, wherein said outer cylinder is formed from ultrahard steel.

11. An apparatus as set forth in claim 1, wherein said screw is formed from tool steel and has a hardened surface coated with a ceramic material.

12. An apparatus as set forth in claim 1, wherein said outer cylinder is formed from tool steel and has a hardened surface coated with a ceramic material.

13. An apparatus as set forth in claim 1, wherein said screw is of the type which is cooled by water supplied thereinto.

* * * * *